US009566210B2

(12) United States Patent
Aelen et al.

(10) Patent No.: US 9,566,210 B2
(45) Date of Patent: Feb. 14, 2017

(54) CHEST FOLLOWING ALGORITHM FOR AUTOMATED CPR DEVICE

(75) Inventors: Paul Aelen, Eindhoven (NL); Pierre Hermanus Woerlee, Valkenswaard (NL); Igor Wilhelmus Franciscus Paulussen, Nuenen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 562 days.

(21) Appl. No.: 13/881,377

(22) PCT Filed: Nov. 2, 2011

(86) PCT No.: PCT/IB2011/054861

§ 371 (c)(1),
(2), (4) Date: Apr. 25, 2013

(87) PCT Pub. No.: WO2012/063163

PCT Pub. Date: May 18, 2012

(65) Prior Publication Data

US 2013/0218056 A1 Aug. 22, 2013

(30) Foreign Application Priority Data

Nov. 11, 2010 (EP) ..... 10190850

(51) Int. Cl.
*A61H 31/00* (2006.01)

(52) U.S. Cl.
CPC ..... *A61H 31/00* (2013.01); *A61H 31/004* (2013.01); *A61H 31/006* (2013.01);
(Continued)

(58) Field of Classification Search
CPC ..... A61H 31/00; A61H 2031/001; A61H 2031/002;A61H 2031/003; A61H 31/004; A61H 31/005; A61H 31/006; A61H 31/008; A61H 2201/1619; A61H 2203/0456; A61H 2205/08; A61H 2205/084; A61H 2201/5061; A61H 2201/5064; A61H 2201/0173; A61H 2201/5007
(Continued)

(56) References Cited

U.S. PATENT DOCUMENTS 5,327,887 A * 7/1994 Nowakowski ..... A61H 31/006 128/202.13
5,399,148 A * 3/1995 Waide ..... A61H 31/00 601/106
(Continued)

FOREIGN PATENT DOCUMENTS

EP 1854444 A1 11/2007
WO 2009037621 A2 3/2009
(Continued)

*Primary Examiner* — Justine Yu
*Assistant Examiner* — Tu Vo

(57) ABSTRACT

A method for automated CPR includes controlling a position of a compression element during movement of the compression element from an initial starting position (P0) of a first compression cycle to a first compression position (P1) corresponding to a first compression depth and back to a rest position of the compression element. After, the rest position has been reached, the method includes controlling a force exerted on the compression element, to ensure that the compression element stays in contact or re-contacts with the chest while allowing the chest to move upward due to ventilation, prior to the start of a second compression cycle.

15 Claims, 2 Drawing Sheets

(52) U.S. Cl.
CPC ..... *A61H 2201/018* (2013.01); *A61H 2201/0173* (2013.01); *A61H 2201/501* (2013.01); *A61H 2201/5007* (2013.01); *A61H 2201/5012* (2013.01); *A61H 2201/5051* (2013.01); *A61H 2201/5056* (2013.01); *A61H 2201/5061* (2013.01); *A61H 2201/5064* (2013.01); *A61H 2205/08* (2013.01); *A61H 2205/084* (2013.01)

(58) Field of Classification Search
USPC ..... 601/41–44
See application file for complete search history.

(56) References Cited

U.S. PATENT DOCUMENTS 5,769,800 A * 6/1998 Gelfand ..... A61H 9/0078 601/151
6,066,106 A 5/2000 Sherman et al.
6,171,267 B1 1/2001 Baldwin
2002/0026131 A1 2/2002 Halperin
2002/0177793 A1* 11/2002 Sherman ..... A61H 31/00 601/41
2004/0230140 A1 11/2004 Steen et al.
2007/0270724 A1* 11/2007 Havardsholm ..... A61H 31/004 601/41
2008/0119766 A1 5/2008 Havardsholm et al.
2009/0062701 A1* 3/2009 Yannopoulos ..... A61H 9/0078 601/41
2010/0004571 A1 1/2010 Nilsson et al.
2010/0022904 A1 1/2010 Centen
2010/0185127 A1* 7/2010 Nilsson ..... A61H 31/004 601/41
2010/0198118 A1* 8/2010 Itnati ..... A61H 31/004 601/41
2011/0092864 A1* 4/2011 Woerlee ..... A61H 31/00 601/41

FOREIGN PATENT DOCUMENTS

WO 2009077967 A1 6/2009
WO 2009156924 A1 12/2009

* cited by examiner

CHEST FOLLOWING ALGORITHM FOR AUTOMATED CPR DEVICE

FIELD OF THE INVENTION

The field of the present invention relates to a method and device for automated cardiopulmonary resuscitation (CPR), as well as to a computer program product comprising a non-transitory computer-usable medium having control logic stored therein for causing a transceiver to execute a method for automated CPR.

DESCRIPTION OF THE RELATED ART

Sudden Cardiac Arrest (SCA) remains one of the main causes of death in the western world. The resulting whole body ischemia after the SCA disturbs a wide range of cell processes, leading to severe cell damage and death unless acute medical care is available. It has been reported that the probability for survival after sudden cardiac arrest decreases linearly with 7-10% per minute of arrest time.

Cardio Pulmonary Resuscitation (CPR) procedure can be performed whenever a patient suffers a sudden cardiac arrest. The procedure consists in performing regular and rhythmic chest compressions to the sternum of the patient, at a rate of 100 compressions per minute. A successful CPR requires that high force be applied to the chest and it may be very difficult to perform consistent high-quality manual chest compressions. Since CPR is key for survival, mechanical automated devices (A-CPR) have been developed to replace less reliable, frequently interrupted, difficult to control, and sometimes lengthy in duration manual CPR.

Different automated CPR apparatus have been introduced in the market. A first type of CPR apparatus uses techniques such as pneumatics to drive a compression pad on to the chest of the patient. Another type of automated CPR is electrically powered and uses a large band around the patient's chest which contracts in rhythm in order to deliver chest compressions. The compression frequency is fixed and is controlled and high quality chest compressions can be achieved.

The automated systems often induce trauma, such as rib-braking, skin lesions and all sorts of trauma. Important issues in the CPR devices include long set-up times, low stability during operation of the device, as well as suggestions and clinical evidence that insufficient force is being applied for optimal performance.

During CPR, it is possible that the chest does not recoil to exactly the same position as where the compression started, and that the recoil point of the chest can drift a few centimeters over the course of resuscitation. This can be due to continuous large compression forces. This is referred to as the molding effect.

Optimal chest compressions can only be given when the compression pad/actuator is in contact with the chest at the start of a compression. However, during CPR the thorax diameter of a victim can decrease due to rib-breakage or molding due to continuous large compression forces. When the compression actuator always retracts to a fixed position, a gap may arise between the actuator and the thorax.

It is also common that the patient has to be ventilated during CPR. When a patient is ventilated, its chest will rise in the order of a centimeter due to this ventilation. When the compression actuator is fixed at its zero position in between chest compressions, the thorax excursion due to ventilations is limited due to the fixed actuator, compromising the effect of the ventilation.

Accordingly, there is a need for an improved automated CPR device and method for performing automated CPR that allows for optimal chest compressions.

Another object of the present disclosure is to provide an improved automated CPR device and method for performing automated CPR that allows for optimal ventilations in the course of resuscitation.

BRIEF SUMMARY OF THE INVENTION

The present disclosure teaches a method for automated CPR comprises: controlling a position of a compression element during movement of the compression element from a first starting position of a first compression cycle to a first compression position corresponding to a first compression depth and back to a rest position of the compression element, and after the rest position has been reached, controlling a force exerted on the compression element until a second compression cycle starts.

In a first aspect of the disclosure, the controlling of the force exerted on the compression element comprises imposing a counterforce.

In yet another aspect of the disclosure, the compression element is driven by a motor and wherein the controlling of the force exerted on the compression element comprises limiting a power of the motor. The power may be limited by applying a limited current on the motor.

The method in one aspect of the disclosure further comprises calculating a second compression depth for the second compression cycle, wherein a final position of the first compression cycle is a second starting position of the compression element for the second compression cycle.

In yet another aspect of the disclosure, the method for automated CPR may comprise limiting a difference between the first compression depth and the second compression depth to a maximum depth deviation.

The maximum depth deviation may be comprised in a range of 1 to 3 centimeters.

In another aspect of the disclosure, the controlling of the position and/or the controlling of the force are enabled at fixed enabling times.

The controlling of the position and/or the controlling of the force may also be disabled at fixed disabling times.

A transition period may be provided between the controlling of the position of the compression element and the controlling of the force exerted on the compression element.

In a further aspect of the present disclosure, the controlling of the force is performed for a time window comprised between about 0.2 second and about 0.6 second.

In yet a further aspect of the present disclosure, the method for automated CPR comprises analyzing a position of the compression element during the controlling of the force exerted on the compression element.

The present disclosure also teaches a computer program product comprising a non-transitory computer-usable medium having control logic stored therein for causing a transceiver to execute a method for automated CPR according to the present disclosure.

According to the disclosure, a device for automated CPR comprises a computer program product comprising a non-transitory computer-usable medium having control logic stored therein for causing a transceiver to execute a method for automated CPR according to the present disclosure.

The disclosure also teaches a device for automated CPR. The device for automated CPR comprises a CPR element comprising a compression element adapted to apply a compression force to a patient's chest, and a control element adapted to control a position of the compression element during movement of the compression element from a first starting position of a first compression cycle to a first compression position corresponding to a first compression depth and back to a rest position of the compression element, and to control a force exerted on the compression element, after the rest position has been reached and until a second compression cycle starts.

Accordingly, according to the present disclosure, a force control is interposed between position control during compressions. This allows the compression element to stay in contact with the chest at all time during the compression cycles, whilst allowing full movement of the chest during ventilation if ventilation is performed.

These and other aspects of the invention will be apparent from and illustrated with reference to the embodiment(s) described herein after.

DETAILED DESCRIPTION OF THE EMBODIMENTS

The invention will now be described on the basis of the drawings. It will be understood that the embodiments and aspects of the invention described herein are only examples and do not limit the protective scope of the claims in any way. The invention is defined by the claims and their equivalents. It will also be understood that features of one aspect can be combined with a feature of a different aspect or aspects.

Figure 1:
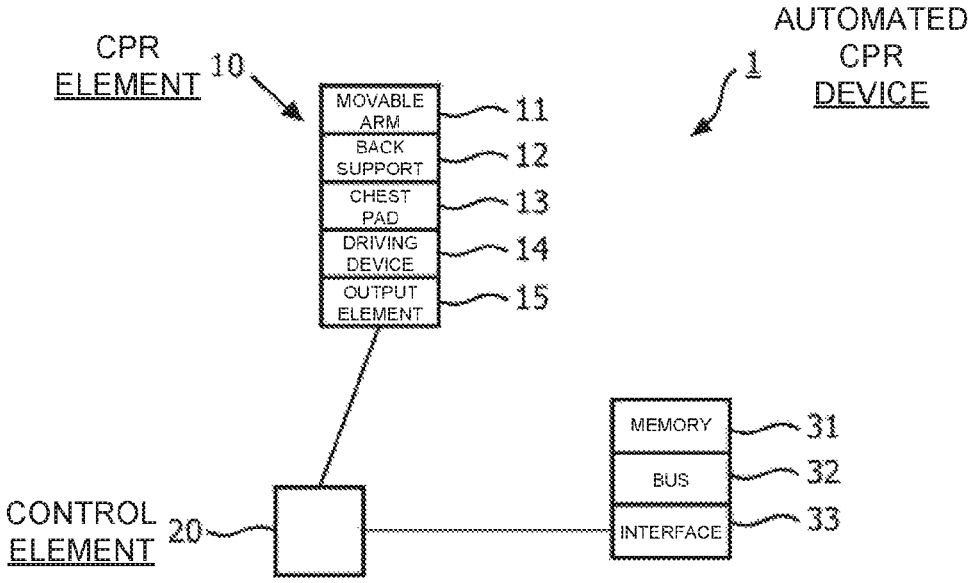
FIG. 1 shows a device for automated CPR according to one aspect of the disclosure.

FIG. 1 shows a device 1 for automated CPR according to one aspect of the disclosure.

The device 1 is adapted to compress and decompress a subject's chest in a cyclical fashion. The device 1 comprises a CPR element 10 adapted to perform the compression/decompression on the subject's chest, and a control element 20 adapted to control the CPR element 10 for a cyclic delivery of compressions. A compression cycle comprises a compression phase where the chest is compressed, a hold time where the compression depth stays at the maximum depth, a retraction phase during which the chest recovers, and a wait time where the thorax stays at the natural zero level.

The CPR element 10 of the device 1 of FIG. 1 comprises a movable unit or arm 11 arranged to move back and forth along a front structure, a back support 12 for positioning behind the patient's back, a chest pad 13 coupled to the arm 11 and adapted to transmit the compression force to the patients' chest, and driving means 14 arranged for, when in operation, driving the movable unit 11 back and forth such that the chest pad 13 cyclically compresses the patient's chest.

The driving means 14 is selected from the group consisting of an electromagnetic, a pneumatic, or a hydraulic motor, which provides either a rotational force, or a linear force, and converts it into a translational or linear motion of the chest pad 13 in the direction of the chest. In a preferred aspect of the disclosure, the driving means 14 are in the form of an electrical motor. The compression depth may be determined by using Hall sensors from the motor 14, wherein each count stands for a certain amount of depth.

It will be understood that other embodiments for the CPR element 10 of FIG. 1 may be contemplated. For example, the CPR element 10 may include a pneumatically driven compressor unit which reciprocally drives the chest pad 13 to mechanically compress/decompress the subject's chest. The subject is rested in a supine position during CPR administration. The compressor unit is mechanically supported vertically above the subject's chest so that the contact pad is in mechanical contact with the subject's chest about the sternum.

Referring back to FIG. 1, the device 1 for automated CPR may also comprise an output element 15 for outputting information or signal representative of the CPR being performed. Output element 15 may include a device that outputs information to an operator, such as a display, a speaker, etc.

It will be appreciated that the device 1 may include other components such as a memory 31, a bus 32 and a communication interface 33, as well as other components (not shown) that aid in receiving, transmitting, and/or processing data. Moreover, it will be appreciated that other configurations are possible.

The memory 31 may include a random access memory (RAM) or another type of dynamic storage device that stores information and instructions for execution by the control element 10, a read only memory (ROM) or another type of static storage device that stores static information and instructions for the control element 10, and/or some other type of magnetic or optical recording medium and its corresponding drive for storing information and/or instructions.

The bus 32 may permit communication among the components of the device 1.

Communication interface 33 may include any transceiver-like mechanism that enables the device 1 to communicate with other devices and/or systems. For example, the communication interface 33 may include mechanisms for communicating with other monitoring devices, such as an ECG monitoring device.

As will be described in detail below in reference with FIGS. 2-4, the device 1 is adapted to perform controlling associated with the delivery of compressions on the patient. The device 1 may perform these and other functions in response to the control element 20 executing software instructions contained in a computer-readable medium, such as a memory.

A computer-readable medium may be defined as one or more memory devices and/or carrier waves. The software instructions may be read into memory 31 from another computer-readable medium or from another device via the communication interface 33. The software instructions contained in memory 31 may cause control element 20 of the device 1 to perform processes that will be described later in reference with FIGS. 2 to 4. Alternatively, hardwired circuitry may be used in place of or in combination with software instructions to implement processes consistent with the principles of the invention. Thus, systems and methods consistent with the principles of the invention are not limited to any specific combination of hardware circuitry and software.

The control element 20 is adapted to control the CPR element 10. The control element 20 may include any type of processor or microprocessor that interprets and executes instructions. In other implementations, the control element 20 may be implemented as or include an application specific integrated circuit (ASIC), field programmable gate array (FPGA), or the like.

Figure 2:
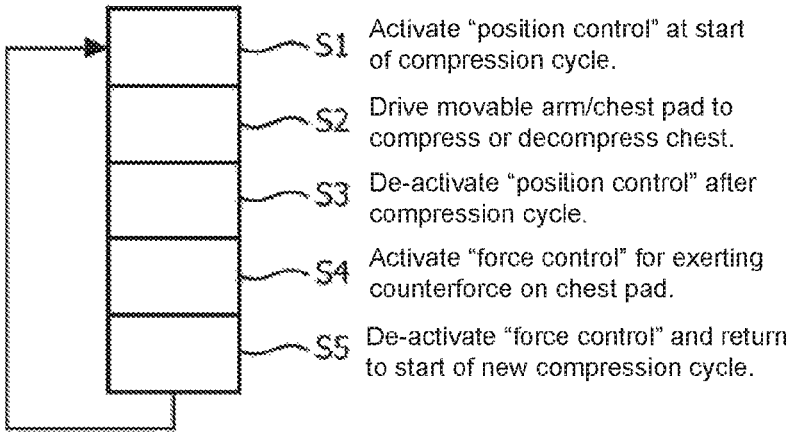
FIG. 2 shows a flowchart of a method in one aspect of the disclosure as proposed by the teachings disclosed herein.

FIG. 2 shows a flowchart of a method for automated CPR in one aspect of the disclosure. The method for automated CPR is described with reference to FIG. 3 and FIG. 4. FIG. 3 shows a position of the compression element with time for two compression cycles, and FIG. 4 shows a position of the compression element with time for different compression cycles in one aspect of the disclosure.

The method in this aspect of the disclosure is described for a device 1 for automated CPR comprising a compression element in the form of a chest pad 13 coupled to a movable arm 11 cyclically compressing/decompressing the patient's chest, and with an electrical motor 14 driving the movable arm 11. This is not limiting the present invention, and the teachings disclosed therein may also apply to other configurations of devices adapted for automated CPR having an electrical motor 14 for driving the compression element.

In a first step S1, at the start of the compression T0, the chest pad 13 is preferably in contact with the patient's chest, at a first initial position P0. The control element 20 activates a position control for controlling the position of the compression element, i.e. the chest pad 13 coupled to the movable arm 11. The position control is aimed at ensuring that a compression pulse for driving the movable arm 11 to a first position P1 corresponding to a first compression depth D1 is followed optimally. The chest pad's initial position P0, also referred to as the initial zero position, is stored.

In a second step S2, the control element 20 sends the compression pulse to the driving means 14 adapted for driving the movable arm 11 and the chest pad 13 to compress or decompress the patient's chest. As a result, the chest pad 13 travels to the first position P1 corresponding to said first compression depth D1, for compressing the chest, and back to a rest position (preferably the first initial position P0) during refraction of the chest after compression.

It will be understood that the compression depth may depend on the specific patient and his body or thorax properties. Typically, the compression depth is of the order of 4 to 6 cm.

In a preferred aspect of the disclosure, the driving means 14 is in the form of an electrical motor. The distance covered by the movable arm 11 or chest pad 13 during compression may be determined by using Hall sensors from the electrical motor 14, wherein each count stands for a certain amount of depth. Once the movable arm or chest pad 13 has covered an effective distance corresponding to the first compression depth D1, the movable arm 11 or chest pad 13 may be hold for a certain time during which the compression depth stays at the maximum depth, whereafter travelling back, thereby allowing the retraction of the chest. However, this is not limiting, and other sensing and controlling solutions may be contemplated for sensing and controlling the distance covered by the movable arm 11 and the chest pad 13.

Figure 3:
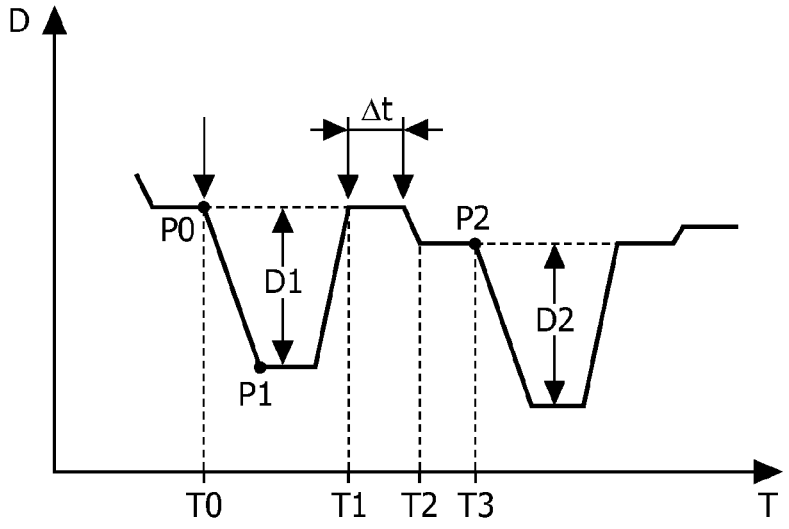
FIG. 3 shows a position of the compression element with time for two compression cycles, in the method of FIG. 2 according to one aspect of the disclosure.

At step S3, once the chest pad 13 has returned back to the rest position, the control element 20 disables the position control (instant T1 on FIG. 3), and activates a force control at step S4 (instant T2 on FIG. 3). The force control is adapted for controlling a force exerted on the chest pad 13, until the next compression cycle starts.

The force control is adapted to add a counterforce to the chest, to ensure that the chest pad 13 stays in contact or re-contacts with the chest whilst allowing the chest to move due to ventilation if a ventilation is performed. The re-contact takes place when the chest pad 13 has been retracted to its original position, where the chest itself did not recoil fully due to molding effects. It should be understood that the force control is enabled after each compression cycle, irrespective of whether a ventilation is to be performed or not. Indeed, in a typical CPR procedure, the patient is ventilated every 30 compression cycles.

The counterforce may be set by applying a limited current to the motor 14 which in turn applies a limited force to the compression pad 13. This can be done by limiting the current of the motor 14, thereby limiting the strength or power of the motor. For example, the counterforce may be set by sending a fixed current through the motor windings of the motor 14. Alternately, the counterforce may be set by adapting a fixed current to the output of a force sensor. These examples are not limiting the present disclosure.

It will be understood that the counterforce should be relatively small, with amplitude of the counterforce in an order of 1 Newton to 50 Newton, preferably approximately 20 Newton. The counterforce is aimed to ensure that the chest pad 13 does not block movement of the chest rising up during ventilation, whilst allowing the chest pad to stays in contact during movement of the chest due to ventilation.

In one aspect of the disclosure, the position and the force control are enabled at fixed time during the CPR. Preferably, the counterforce is applied for a time window typically comprised between 0.2 second and 0.6 second.

The force control is applied for a fixed time. The recoil's position of the chest after this fixed time, and possibly after a ventilation, is the new starting position P2 of the chest pad 13, for the next compression cycle.

At step S5, the force control is disabled and the position control is enabled for the next compression cycle. The control element 20 determines the next compression depth D2, taking account of the new starting position P2 of the chest pad 13. A compression pulse for driving the movable arm 11 to the second compression depth D2 is computed, and the next compression cycle begins (instant T3 on FIG. 3)

Figure 4:
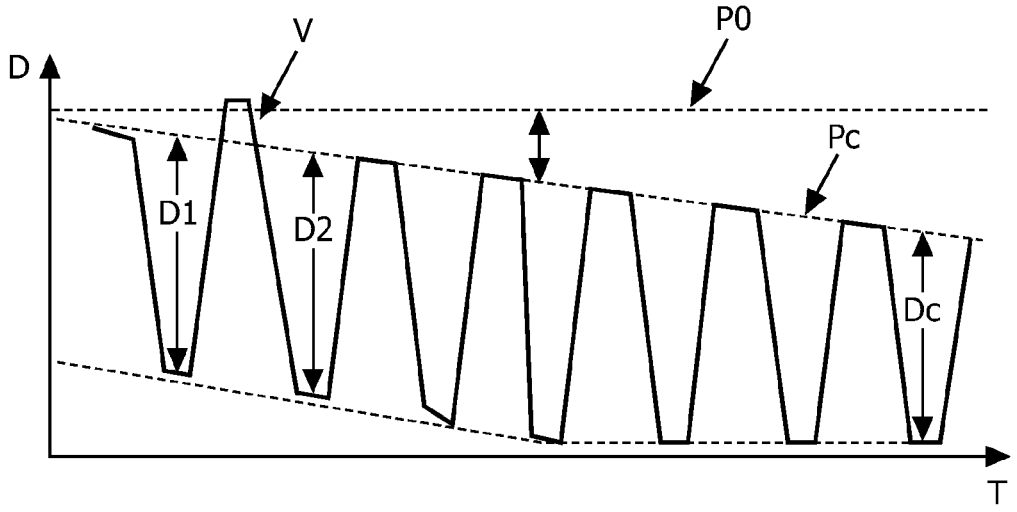
FIG. 4 shows a position of the compression element with time for seven compression cycles, in the method of FIG. 2 according to the teachings disclosed therein For a complete understanding of what is taught and the advantages thereof, reference is now made to the following detailed description taken in conjunction with the Figures.

It will be understood that the starting point of each compression is determined by the amount of recoil of the chest, as illustrated on FIG. 4. FIG. 4 shows the first initial position P0 for the first compression cycle, and a current zero position Pc along different compression cycles. Seven cycles are shown on FIG. 4.

Each compression starts at the final location of each previous compression, or, in other words, the position of the chest pad 13 at the start of a new compression is the new current zero position Pc. The compression depth is calculated from the new current zero position Pc.

Advantageously, the molding effect of the chest is taken into effect. Indeed, the recoil point of the chest can drift a few centimeters over the course of a resuscitation. Computing the compression depth from the current zero position of the chest pad 13 ensures that the effective compression depth is not diminished by the amount of depth that the chest has molded. The effective compression depth stays in the required range for effective CPR.

Additionally, because the present zero position Pc corresponds to the recoil point of the chest, trauma, which appears when the chest pad starts at a height that is some cm's above the thorax and contacts the thorax with a relative high velocity, is avoided.

As illustrated on FIG. 4, a ventilation V is performed after the first compression cycle of FIG. 4. The chest pad 13 is allowed to closely follow the chest's movement during the ventilation. This is achieved through the force control which does not block movement of the chest, whereas prior art systems simply block the chest pad at a fixed position after compression has taken place.

In one aspect of the disclosure, the depth deviation is limited so that harm to the patient is minimized. Indeed, when the current zero position Pc changes too much with respect to the initial zero position P0, the distance between the sternum and spine of the patient gets smaller and smaller. In this case the effective compression depth (D1, D2, . . . , Dc) will be diminished by the amount of extra depth deviation, so that contact with the chest is never lost. Preferably the depth deviation is limited in the range of 1 to 3 cm.

The man skilled in the art will also recognize that the present disclosure allows the analysis of the chest pad's position when the force control is enabled, for a compression cycle. The analysis of the chest pad's position may comprise the analysis of an absolute position of the chest pad 13. The analysis of the chest pad's position may also comprise the analysis of a relative position of the chest pad 13, with respect to the previous compression cycle.

Advantageously, the analysis of the chest pad's position when the force control is enabled may provide information about ventilation and molding effects. In particular, if the chest pad 13 is moved more than a certain amount for one single compression, this effect cannot be due to chest molding, which is a slow process, but has to be caused by ventilation.

According to the present disclosure, a force control is interposed between position control during compressions. Preferably, the force control and position control are enabled and disabled at fixed times during compression cycles. This allows the pad to stay in contact with the chest at all time during the compression cycles, whilst allowing full movement of the chest during ventilation if ventilation is performed.

Other variations to the disclosed embodiments can be understood and effected by those skilled in the art in practising the claimed invention from study of the drawings, the disclosure, and the appended claims. In the claims, the word "comprising" does not exclude other elements or steps, and the indefinite article "a" or "an" does not exclude a plurality. A single unit may perform functions of several items recited in the claims, and vice versa. The mere fact that certain measures are recited in mutually different dependent claims does not indicate that combination of these measures cannot be used to advantage. Any reference signs found in the claims should not be construed as limiting the scope.

While various embodiments of the present invention have been described above, it should be understood that they have been presented by way of example, and not limitation. It will be apparent to persons skilled in the relevant arts that various changes in form and detail can be made therein without departing from the scope of the invention. In addition to using hardware (e.g., within or coupled to a central processing unit ("CPU"), micro processor, micro controller, digital signal processor, processor core, system on chip ("SOC") or any other device), implementations may also be embodied in software (e.g. computer readable code, program code, and/or instructions disposed in any form, such as source, object or machine language) disposed for example in a non-transistory computer useable (e.g. readable) medium configured to store the software. Such software can enable, for example, the function, fabrication, modeling, simulation, description and/or testing of the apparatus and methods described herein. For example, this can be accomplished through the use of general program languages (e.g., C, C++), hardware description languages (HDL) including Verilog HDL, VHDL, and so on, or other available programs. Such software can be disposed in any known non-transitory computer useable medium such as semiconductor, magnetic disc, or optical disc (e.g., CD-ROM, DVD-ROM, etc.). The software can also be disposed as a computer data signal embodied in a non-transitory computer useable (e.g. readable) transmission medium (e.g., carrier wave or any other medium including digital, optical, analogue-based medium). Embodiments of the present invention may include methods of providing the apparatus described herein by providing software describing the apparatus and subsequently transmitting the software as a computer data signal over a communication network including the internet and intranets.

It is understood that the apparatus and method describe herein may be included in a semiconductor intellectual property core, such as a micro processor core (e.g., embodied in HDL) and transformed to hardware in the production of integrated circuits. Additionally, the apparatus and methods described herein may be embodied as a combination of hardware and software. Thus, the present invention should not be limited by any of the above-described exemplary embodiments, but should be defined only in accordance with the following claims and their equivalents.

The invention claimed is:

1. A method for automated cardiopulmonary resuscitation (CPR), the method comprising:

controlling, via (a)(i) a controller enabled for position control and disabled for force control and (a)(ii) a driving device, a position of a compression element during a first compression cycle that comprises a movement of the compression element, via the driving device, from (b)(i) a starting position of the first compression cycle to (b)(ii) a first compression position corresponding to a first compression depth , and back to (b)(iii) a rest position of the compression element; and after the rest position of the compression element has been reached at an end of the first compression cycle, controlling, via (c)(i) the controller disabled for position control and enabled for force control and (c)(ii) the driving device, a force exerted on the compression element until a second compression cycle starts, wherein the controlling of the force exerted on the compression element comprises imposing a counter-force of the compression element to the chest to ensure that the compression element stays in contact with or re-contacts the chest after the first compression cycle while allowing the chest to move upward due to ventilation if ventilation is performed.

2. The method according to claim 1, wherein movement of the compression element. via the driving device, comprises being driven by a motor, and wherein the controlling of the force exerted on the compression element comprises limiting a power of the motor.

3. The method according to claim 2, wherein limiting the power of the motor comprises applying a limited current on the motor.

4. The method according to claim 1, further comprising calculating a second compression depth for the second compression cycle, wherein a final position of the first compression cycle is a second starting position of the compression element for the second compression cycle.

5. The method according to claim 4, further comprising limiting a difference between the first compression depth and the second compression depth to a maximum depth deviation.

6. The method according to claim 5, wherein the maximum depth deviation is comprised in a range of 1 to 3 centimeters.

7. The method according to claim 1, wherein one or more of (i) the controlling of the position and (ii) the controlling of the force are enabled at fixed enabling times.

8. The method according to claim 1, wherein one or more of (i) the controlling of the position and (ii) the controlling of the force are disabled at fixed disabling times.

9. The method according to claim 1, further comprising implementing a transition period between the controlling of the position of the compression element and the controlling of the force exerted on the compression element.

10. The method according to claim 1, wherein the controlling of the force exerted on the compression element is performed within a time window that comprises a range from 0.2 seconds to 0.6 seconds.

11. The method according to claim 1, further comprising analyzing a position of the compression element during the controlling of the force exerted on the compression element to obtain information regarding ventilation and molding effects.

12. A non-transitory computer-usable medium embodied with computer program code for causing a processor to execute a method for automated CPR according to claim 1.

13. The method of claim 1, wherein the controlling of the force exerted on the compression element further comprises imposing a counterforce to the chest in a range of 1 to 50 Newton.

14. A device for automated cardiopulmonary resuscitation (CPR), the device comprising:

a CPR element that comprises a compression element and a driving device, wherein the compression element is adapted to apply a compression force to a patient's chest in response to being driven by the driving device; and a control element adapted (a) to control, in response to being enabled for position control and disabled for force control, a position of the compression element during a first compression cycle that comprises a movement of the compression element from (a)(i) a first starting position of the first compression cycle to (a)(ii) a first compression position corresponding to a first compression depth, and back to (a)(iii) a rest position of the compression element, and (b) to control, in response to being disabled for position control and enabled for force control, a force exerted on the compression element, after the rest position of the compression element has been reached at the end of the first compression cycle and until a second compression cycle starts, wherein the control element controls the force exerted on the compression element by imposing a counterforce of the compression element to the chest to ensure that the compression element stays in contact with or re-contacts the chest after the first compression cycle while allowing the chest to move upward due to ventilation if ventilation is performed.

15. The device of claim 14, wherein the controlled force exerted on the compression element further comprises a counterforce to the chest in a range of 1 to 50 Newton.

* * * * *